US011729553B2

(12) United States Patent
Kwun et al.

(10) Patent No.: US 11,729,553 B2
(45) Date of Patent: Aug. 15, 2023

(54) HEADSET MECHANISM FOR COMFORT COUPLING EAR CUPS TO HEAD

(71) Applicant: Sony Interactive Entertainment Inc., Tokyo (JP)

(72) Inventors: Arthur Charles Kwun, Newark, CA (US); So Morimoto, Kawaguchi (JP)

(73) Assignee: Sony Interactive Entertainment Inc., Tokyo (JP)

( * ) Notice: Subject to any disclaimer, the term of this patent is extended or adjusted under 35 U.S.C. 154(b) by 80 days.

(21) Appl. No.: 16/887,269

(22) Filed: May 29, 2020

(65) Prior Publication Data

US 2021/0377661 A1 Dec. 2, 2021

(51) Int. Cl.
*H04R 25/00* (2006.01)
*H04R 5/033* (2006.01)
*H04R 1/10* (2006.01)

(52) U.S. Cl.
CPC ..... *H04R 5/0335* (2013.01); *H04R 1/1008* (2013.01); *H04R 1/1066* (2013.01)

(58) Field of Classification Search
CPC .. H04R 5/0035; H04R 1/1008; H04R 1/1066; H04R 1/105
USPC ..... 381/370
See application file for complete search history.

(56) References Cited

U.S. PATENT DOCUMENTS 6,542,615 B1 * 4/2003 Ito ..... H04R 1/1066 381/374
9,980,048 B2 * 5/2018 Henderson ..... H04R 5/0335
2012/0288131 A1 11/2012 Vaerum et al.
2015/0245124 A1 8/2015 Lee
2015/0326974 A1 11/2015 Skubinski, III et al.
2016/0080853 A1 3/2016 Chen
2017/0055057 A1 2/2017 Yang et al.
2019/0158949 A1 5/2019 Tsai

OTHER PUBLICATIONS

"International Search Report and Written Opinion" dated Aug. 31, 2021, from the counterpart PCT application PCT/US21/33804.
"MDR-CD 270", Radiomuseum, retrieved from https://www.radiomuseum.org/r/sony_mdr_cd_270.html?language_id=2 on May 27, 2020.

* cited by examiner

*Primary Examiner* — Phylesha Dabney
(74) *Attorney, Agent, or Firm* — John L. Rogitz

(57) ABSTRACT

An apparatus includes an arcuate headband with a continuous band having left and right side portions joining at an apex. The left and right side portions terminate in respective arcuate ends. A head rest band spans between the side portions and is connected to the side portions below the apex and spaced from the apex. Left and right ear cups that define respective centers and respective peripheries are respectively attached to the arcuate ends of the left and right side portions. The arcuate ends of the left and right side portions are juxtaposed with the respective peripheries and are distanced from the respective centers of the respective ear cups. The left and right ear cups are cambered inward from front to back and each include an element that couples a respective arcuate end segment to a hinge inside the respective ear cup.

22 Claims, 6 Drawing Sheets

HEADSET MECHANISM FOR COMFORT COUPLING EAR CUPS TO HEAD

FIELD

The present application is generally related to headset mechanisms for comfortably coupling ear cups to a person's head.

BACKGROUND

Headsets are increasingly worn by people listening to music, playing computer games, etc. As understood herein, prolonged headset wear can cause discomfort.

SUMMARY

Accordingly, in one aspect an apparatus includes an arcuate headband with a continuous band having left and right side portions joining at an apex. The left and right side portions terminate in respective arcuate ends. A head rest band spans between the side portions and is connected to the side portions below the apex and spaced from the apex. Left and right ear cups that define respective centers and respective peripheries are respectively attached to the arcuate ends of the left and right side portions such that the left and right ear cups are cambered inward from front to back. The arcuate ends of the left and right side portions are juxtaposed with the respective peripheries and are distanced from the respective centers of the respective ear cups. The left and right ear cups each include a bar or other element within the respective ear cup that couples a respective arcuate end to a roll hinge inside the respective ear cup. The bar extends radially inward within the respective ear cup from the respective arcuate end and also extends axially inward within the respective ear cup from the respective arcuate end.

In example embodiments, the arcuate end segments may be elongated and lie flush against the respective ear cups, which can include respective audio speakers and an ear cushion configured to engage the side of a person's head. The arcuate end segments may also have curvatures approximating respective curvatures of the peripheries of the respective ear cups. Each side portion can define a long axis in a plane, and the respective arcuate end segment can extend along an arc in the plane. Each arcuate end segment may define a width in a dimension extending away from the respective ear cup and a thickness in a dimension extending along the respective ear cup, and the width can be greater than the thickness.

In some implementations the head rest band may be less arcuate than the apex segment of the headband.

In another aspect, an apparatus includes an arcuate headband with a continuous band having left and right side portions joining at an apex segment. The left and right side portions terminate in respective end segments. The apparatus also includes left and right ear cups that define respective centers and respective peripheries. The ear cups respectively attach to the end segments of the left and right side portions such that the left and right ear cups are cambered inward from front to back, and such that the end segments of the left and right side portions are juxtaposed with the respective peripheries and distanced from the respective centers of the respective ear cups.

In some examples, a head rest band may span between the side portions and may be connected thereto below the apex segment, spaced from the apex segment. The head rest band may include a compliant mechanism for the head rest band to move with respect to the arcuate headband.

In still another aspect, an apparatus includes an arcuate headband with a band having left and right side portions joining at an apex segment. The left and right side portions terminate in respective end segments. Left and right ear cups define respective centers and respective peripheries and are respectively attached to the end segments of the left and right side portions such that the end segments of the left and right side portions are juxtaposed with the respective peripheries and distanced from the respective centers of the respective ear cups.

The details of the present application, both as to its structure and operation, can best be understood in reference to the accompanying drawings, in which like reference numerals refer to like parts, and in which:

DETAILED DESCRIPTION

Figure 1:
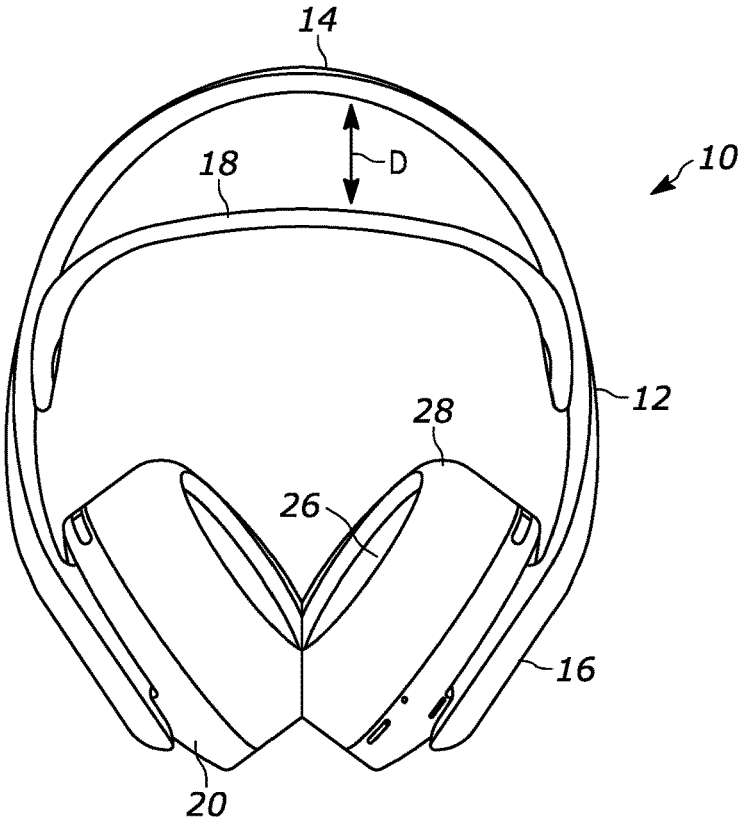
FIG. 1 is a perspective view of an example embodiment of a headset from a first aspect.
Figure 2:
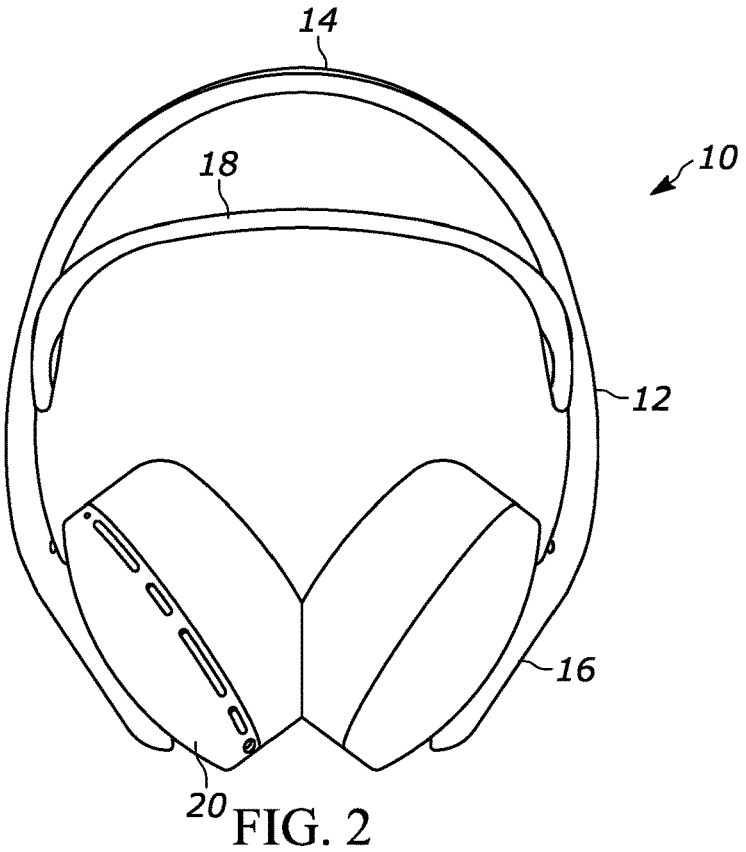
FIG. 2 is a perspective view of the example embodiment of the headset from a second aspect.
Figure 3:
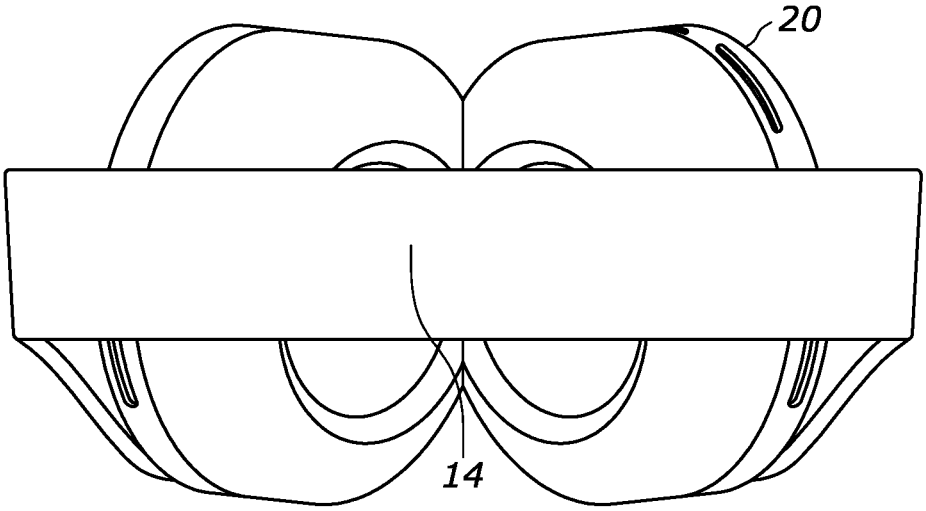
FIG. 3 is a view of the example embodiment of the headset looking down on the headband.

Referring initially to FIGS. 1 and 2, an apparatus 10 includes an arcuate headband that is defined by a continuous band having left and right side portions 12 joining at an apex segment 14. The side portions 12 may be less rounded than the apex segment 14 as shown, and may be integral to the apex segment 14. The side portions 12 and apex segment 14 may be made of plastic or other suitable materials and may be materially biased to the configuration shown, it being understood that the side portions 12 may be pulled away from each other by hand by a person to place the apparatus 10 on his/her head and then released to urge inward toward each other to firmly engage the person's head.

In the example shown, the left and right side portions 12 terminate in respective arcuate end segments 16 which may be integral to the side portions 12 and are described further below.

A head rest band 18 spans between the side portions 12 and is connected to the side portions 12 below the apex segment 14 using, e.g., screws originating from the side portions 12 and extending into respective tracks within the band 18 as will be described further below with respect to FIGS. 11 and 12. However, in other embodiments the head rest band 18 may be glued to the side portions 12 or may be engaged with the side portions 12 using, for example, radio-frequency (RF) welding or ultrasonic sealing. Or, in some embodiments the head rest band 18 may be made integrally with the side portions 12 using, e.g., injection molding techniques. Or in still other embodiments the head rest band 18 may be mechanically engaged with the side portions 12, e.g., by snapping a post on the end of the head rest band 18 into a hole of the respective side portion 12. In the example shown the head rest band 18 is spaced from the apex segment 14 by a distance "D". Also in the example shown, the head rest band 18 (or at least the portion of the head rest band 18 directly below the apex segment 14) is less arcuate than the apex segment 14 of the headband.

Figure 4:
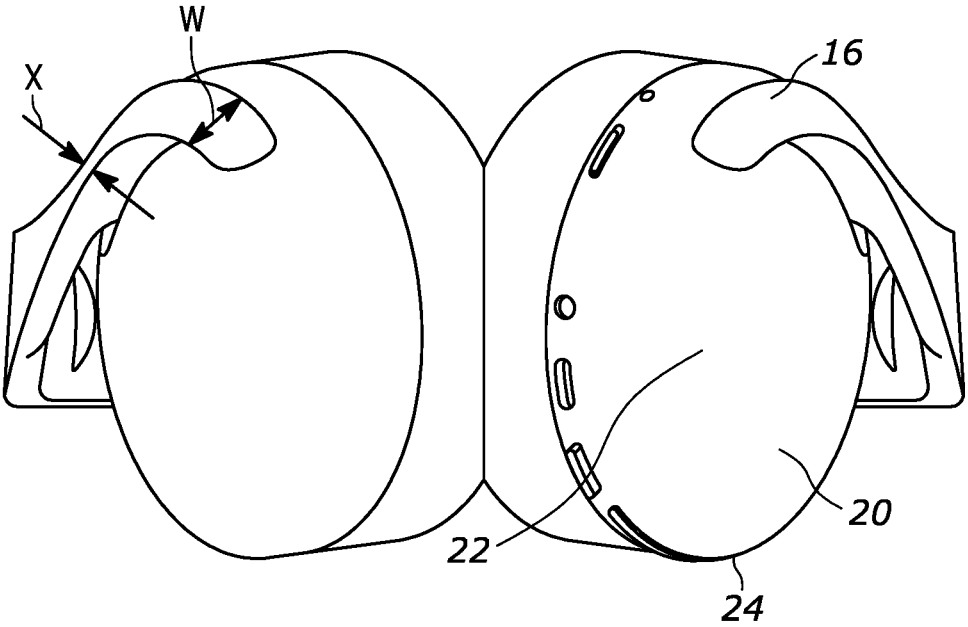
FIG. 4 is a view of the example embodiment of the headset looking down on the ear cups.

FIGS. 1-4 also illustrate left and right ear cups 20 which define respective centers 22 and respective peripheries 24 (as best shown in FIG. 4). The ear cups 20 may be respectively attached at respective front portions to the arcuate end segments 16 of the left and right side portions 12 such that the arcuate end segments 16 of the left and right side portions 12 are juxtaposed with the respective peripheries 24 at least along the respective front portions of the cups 20 and are distanced from the respective centers 22 of the respective cups 20.

The ear cups 20 may be made of plastic or other suitable materials and may be attached to the arcuate end segments 16 as set forth further below with respect to FIG. 10. However, in other embodiments the cups 20 may be attached to/engaged with the arcuate end segments 16 integrally or glued thereto or otherwise attached to the arcuate end segments 16 by mechanical means (e.g., snapping a post on the ear cup into a hole in the end segment) or bonded by other means described herein.

As best shown in FIG. 1, each ear cup may support one or more audio speakers 26 and may have an inner soft and/or resilient annular ear cushion 28 configured to gently engage the side of a person's head.

Figure 5:
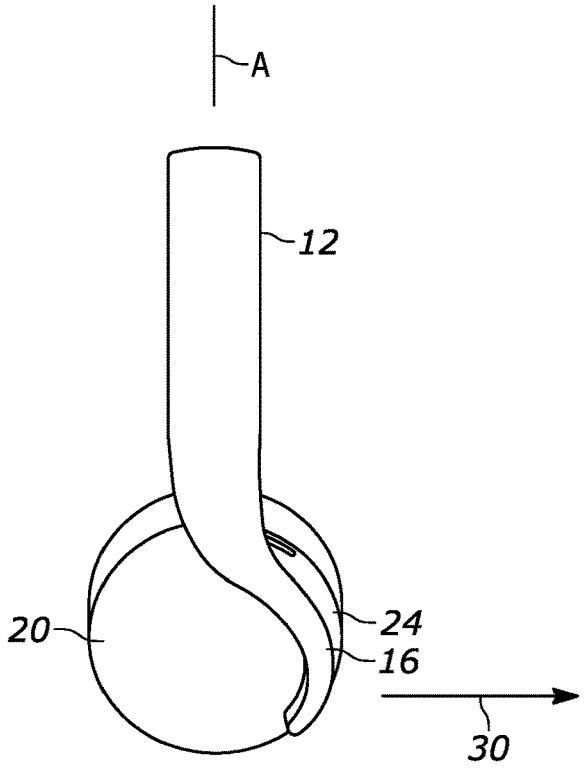
FIGS. 5 and 6 are views of the example embodiment looking at the left and right portions of the headband.
Figure 6:
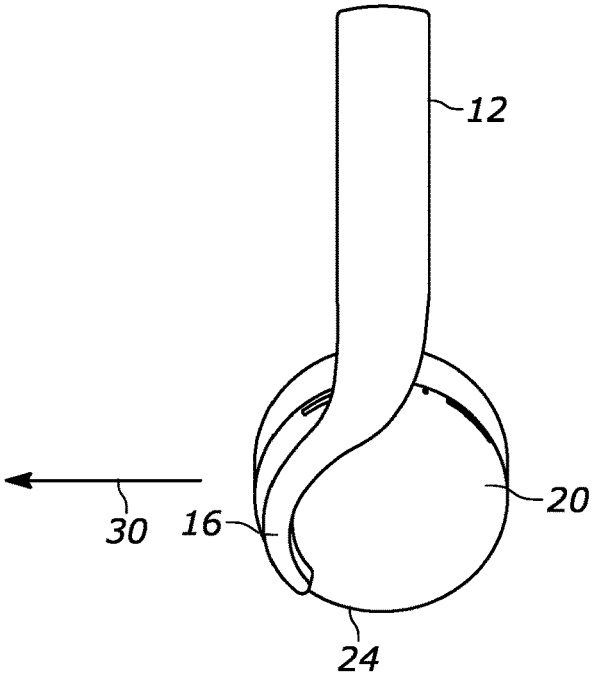

FIGS. 5 and 6 illustrate additional details consistent with present principles, with FIG. 5 showing a respective cup 20 for the person's right ear and FIG. 6 showing a respective cup 20 for the person's left ear. Front portions of the respective cups 20 are illustrated with respect to the forward-facing direction/axis of the apparatus 10 itself as indicated via the arrows 30 for the forward-facing direction/axis.

As also shown in FIGS. 5 and 6, the arcuate end segments 16 may be elongated and may lie flush against the respective ear cups 20. The arcuate end segments 16 may have curvatures approximating respective curvatures of the peripheries 24 of the respective ear cups 20. Each side portion 12 may define a long axis "A" in a plane (FIG. 5), and the respective arcuate end segment 16 may extend along an arc in the plane. Thus, the arcuate end segments 16 may lie along the respective peripheries of the respective ear cups 20 and have curvatures that generally match the curvature of the respective peripheries of the ear cups 20.

FIG. 4 perhaps best shows that in one example, each end segment 16 has a width "W" in the dimension extending away from the respective ear cup 20 and a thickness "t" in the dimension extending along the respective ear cup 20. In the example shown, the width "W" is greater than the thickness "t", so that the arcuate end segment 16 appears to be standing on edge on the respective ear cup 20.

Note that owing to the respective arcuate end segments 16 being attached to respective the front portions of the respective ear cups 20, the arcuate end segments 16 themselves may seek to apply pressure to the person's head where the front of the cups 20 and ear cushions 28 meet the head.

As also shown in FIGS. 1-4, the ear cups 20 may be cambered inward toward each other from front to back so that respective rear portions of the ear cups 20 may apply greater pressure to the person's head when the assembly 10 is worn than respective front portions of the ear cups 20 based on the cambering itself. The cambering of the ear cups 20 may be established and maintained by attachment of the ear cups 20 to the arcuate end segments 16 so that there is no movement of the ear cups with respect to the segments 16 at least along the yaw axis.

Figure 7:
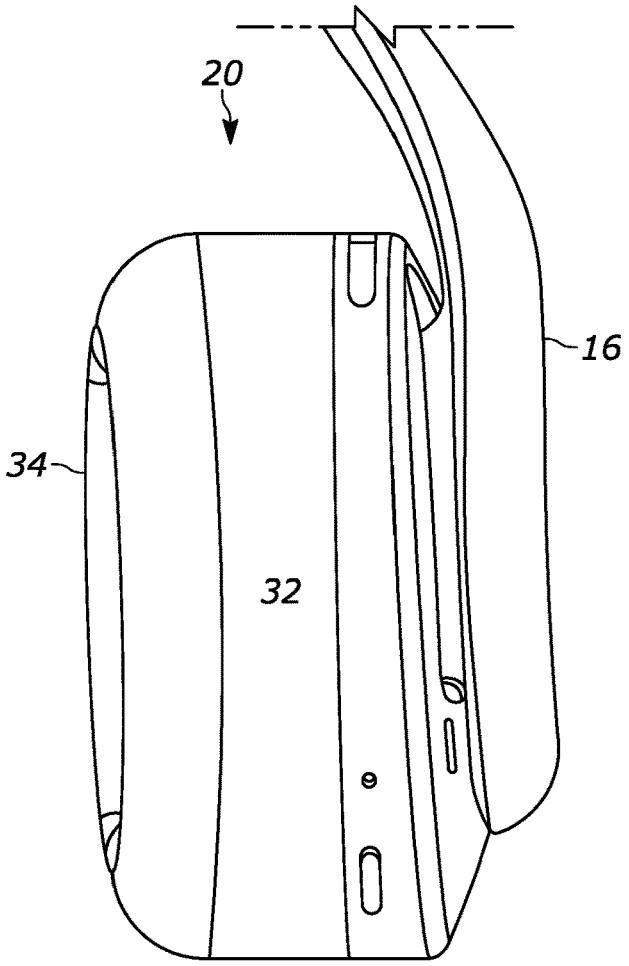
FIG. 7 is a front elevational view of an example embodiment of the left ear cup showing cambering of the left ear cup.
Figure 8:
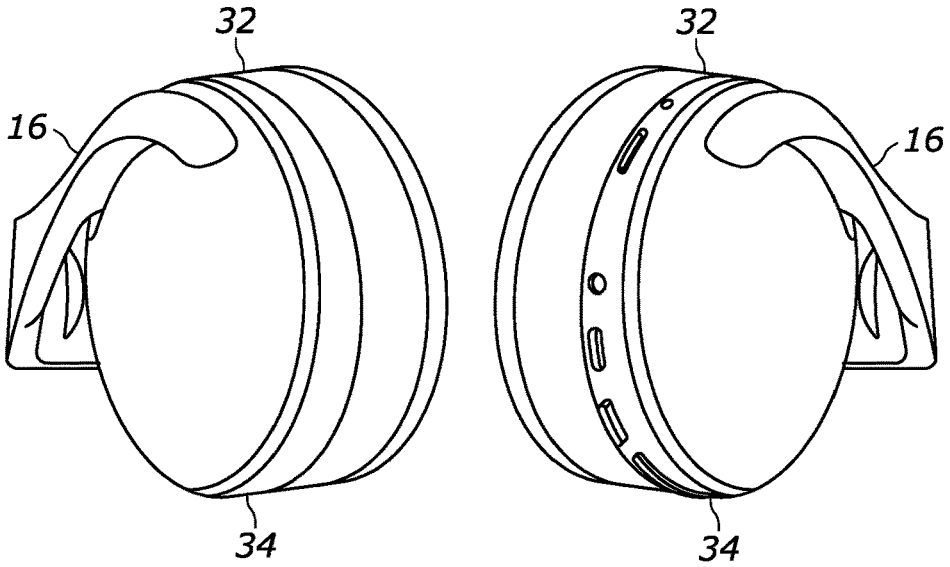
FIG. 8 is a view of an example embodiment looking down on the ear cups and showing cambering of the ear cups as spaced apart from each other.
Figure 9:
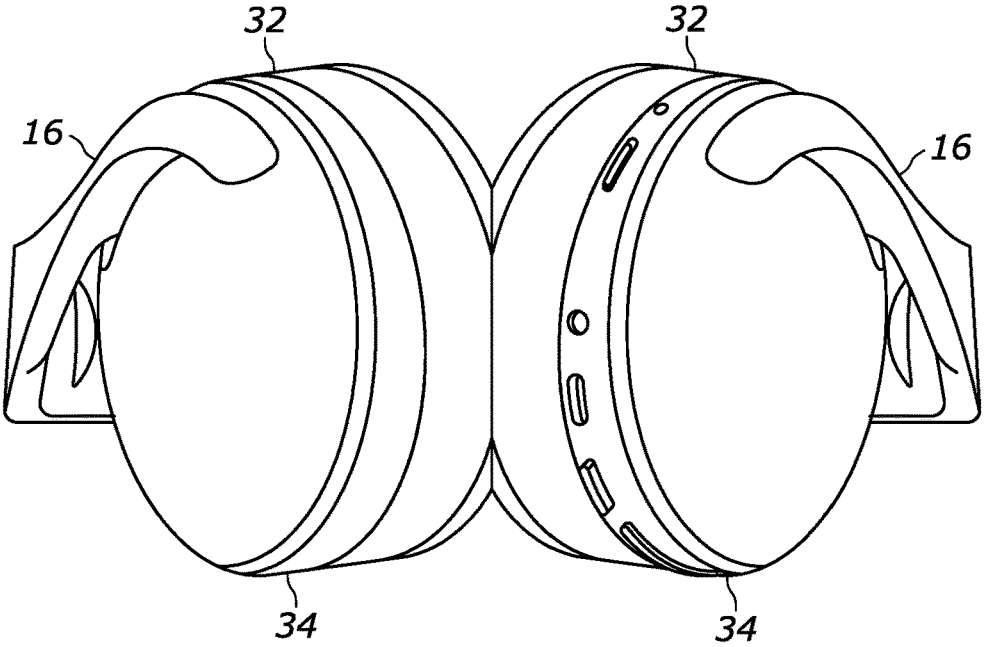
FIG. 9 is a view of an example embodiment looking down on the ear cups and showing the cambering of the ear cups as contacting each other under bias from the arcuate headband.

FIG. 7 further illustrates the cambering where it shows a front elevational view of the left ear cup 20 with a front portion 32 of the cup 20 pointing outward obliquely away from the forward-facing axis of the apparatus 10 itself and a rear portion 34 of the cup 20 oriented inward obliquely toward the forward-facing axis so that the cup 20 as a whole is oriented for inward cambering from front to back. The bottom plan views of FIGS. 8 and 9 further illustrate. FIG. 8 shows the cups 20 spaced apart from each other. FIG. 9 shows the cups 20 contacting each other under bias from the arcuate headband when not worn by a person so that at least some parts of the respective bottom portions of the cups 20 contact each other and at least some parts of the respective rear portions 34 of the cups 20 also contact each other.

Figure 10:
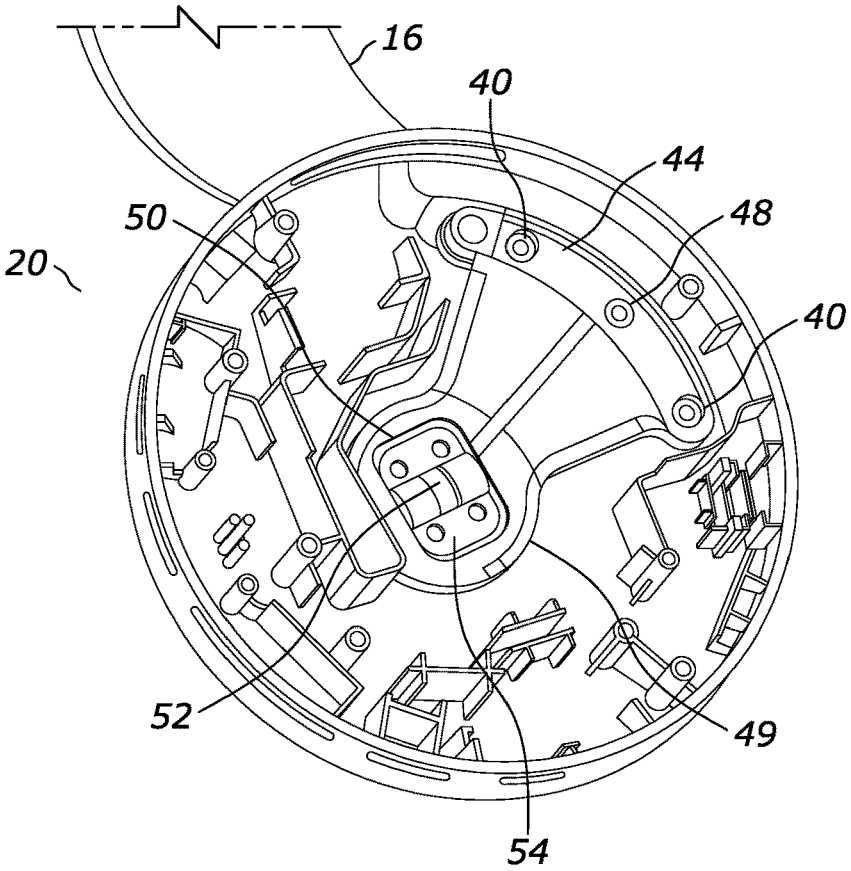
FIG. 10 is a cutaway view of the inside of one of the cups according to an example embodiment.

Now in reference to FIG. 10, it shows a cutaway view of the inside of the left cup 20, with it being understood that the right cup 20 may also have similar components. As shown in FIG. 10, a portion of the left arcuate end segment 16 may extend axially into the cup 20 through a groove or opening in the outer side of the housing of the cup 20 so that the segment 16 may attach to an extension bar 44 or other structural element inside the cup 20 using screws (not shown). The screws themselves may extend through respective holes 40 in a first end segment 48 of the bar 44 and into threaded holes in the segment 16. The groove or opening itself may be configured so that the segment 16 (e.g., including outer-most portions thereof in some examples) may sit flush with the outer surface of the outer side of the housing of the cup 20.

As also shown in FIG. 10, the first end segment 48 of the bar 44, once engaged with or attached to the segment 16, may be axially proximate to, abutting, or contacting an inner surface of the outer side of the housing of the cup 20. In some examples, the end segment 48 may have an arcuate or curved shape as shown that generally matches the curvature of the periphery of the cup 20 itself.

FIG. 10 further shows that an opposite end segment 49 of the bar 44 may form part of a roll hinge 50, it being understood that no yaw hinge may exist on the cup 20 and/or no yaw rotation permitted for the cup 20 with respect to the side portion 12 and/or segment 16 specifically. The end segment 49 may be established by a partially disk-like structure as shown and may have a generally rectangular hole inside of it as also shown. Extending from one side of the rectangular hole to an opposite side of the rectangular hole as shown may be a pin 52 that also integrally forms part of the end 49 and hence part of the bar 44. A bracket 54 may then be placed into the rectangular hole and over the pin 52. The bracket 54 may then be screwed into structure of the cup 20, including possibly a portion of the inner surface of the outer side of the housing of the cup 20 using the four holes shown on the bracket 54 to sandwich the pin 52 between the bracket 54 and the structure. The bracket 54 may thus permit one degree of cup rotation along a roll axis while not permitting cup rotation along a yaw axis (or pitch axis for that matter).

Furthermore, as alluded to above, components of the cup 20 and segment 16 may be configured (e.g., molded) so that the bar 44 may be oriented within the cup 20 once attached to the segment 16 so that the end segment 48 may be axially proximate to or abutting the inner surface of the outer side of the housing of the cup 20. Then as the bar 44 extends radially inward within the cup 20 from the end segment 48 to the end segment 49, the bar 44 may also extend axially inward from the end 48 to the end 49 away from the inner surface of the outer side of the housing at an angle between five and ten degrees, and possibly between six and a half degrees and eight and a half degrees specifically. In some examples the angle may be seven and a half degrees specifically. This may help establish the camber described above in reference to FIGS. 7-9, and the bar 44 may therefore help to divert pressure the person would otherwise feel at the front portion of the cup 20 due to the arcuate end segment 16 attaching to the cup 20 at the front portion and being biased inward toward the person's head. The aforementioned angle ranges, and the seven and a half degree angle specifically, may thus aid the comfort of the user and maintain more-even pressure distribution of the cup 20 against the head.

Regarding material that may be used to form the bracket 52 and bar 44, those components may be formed by any suitable material such as a plastic or metal.

Figure 11:
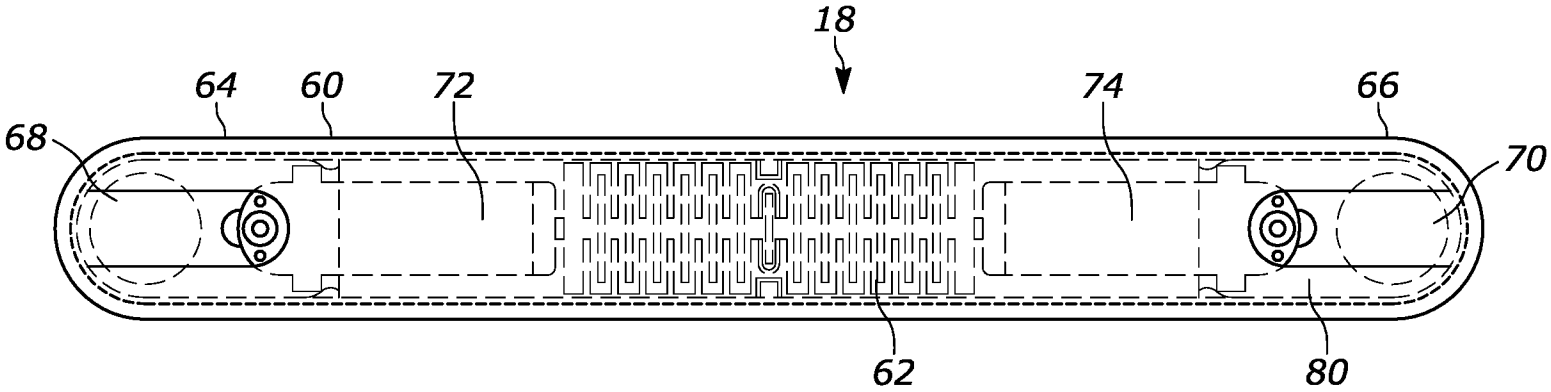
FIG. 11 is a transparency top plan view of a head rest band that attaches to the arcuate headband according to an example embodiment.
Figure 12:
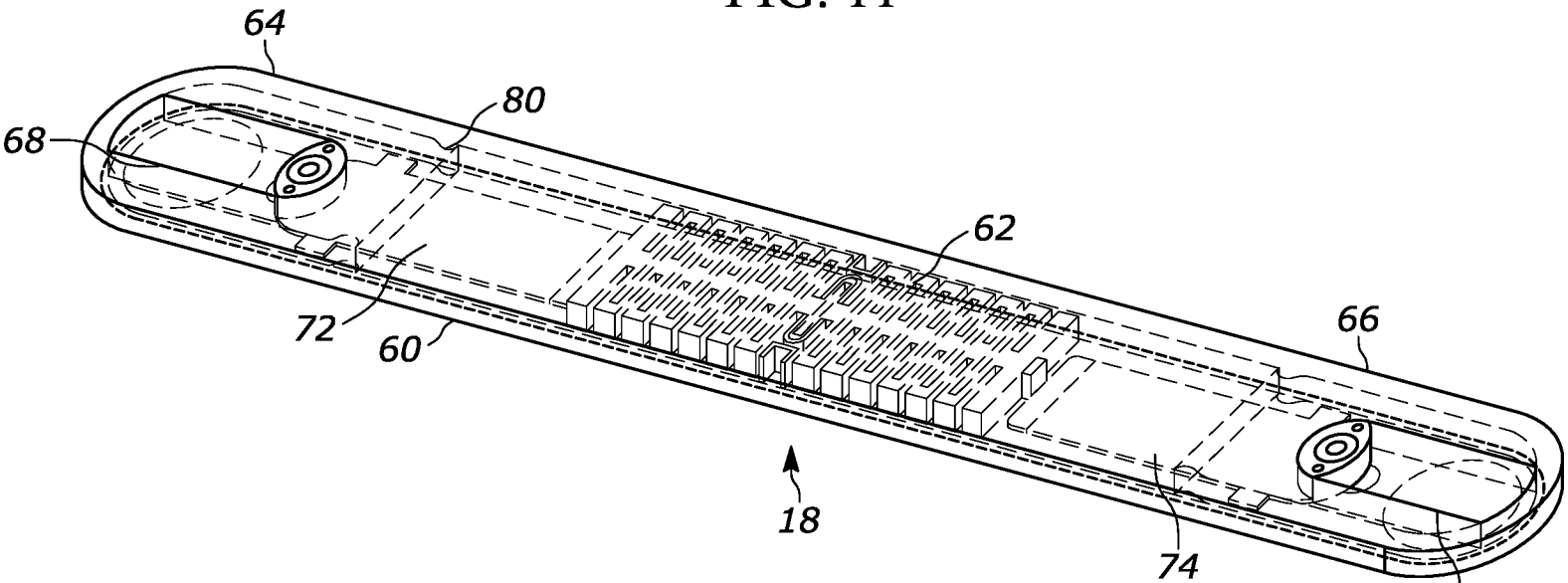
FIG. 12 is a transparency perspective view of the head rest band according to an example embodiment.

Continuing the detailed description in cross-reference to FIGS. 11 and 12, they both show transparency views of internal components of the head rest band 18 described above. FIG. 11 shows a top plan transparency view while FIG. 12 shows a perspective transparency view.

As shown in these figures, an outer surface 60 of the elongated band 18 may define the external shape and contours of the band 18, may be at least partially hollow to accommodate internal components that will be described shortly, and may be made of a suitable material such as rubber or silicone or another polymer, for example. The band 18 may also establish opposing end segments 64, 66 as shown.

The hollow space inside the band 18 may house a compliant mechanism 62 or elastic band or another suitable component. If an elastic band is used, the elastic may be established by, for example, cord, tape, or fabric that is woven with strips of rubber so that the elastic may return to its initial length and/or shape after being stretched or manipulated. A rubber band may also be used rather than the compliant mechanism 62 shown in FIGS. 11 and 12, and/or silicone or another polymer-type of band may also be used. Further, in addition to or in lieu of using the compliant mechanism 62 or a rubber or elastic band, a spring may be positioned longitudinally within the band 18 at the same location as the compliant mechanism 62 for similar use consistent with present principles. Regardless, the compliant mechanism 62 or other component that is used may be attached at opposing end segments thereof to tabs 72, 74 as also shown in FIGS. 11 and 12. The tabs 72, 74 may glued to or formed integrally with the mechanism 62 or other component.

During manufacturing, the tabs 72, 74 may also be attached by screws, tacks, or nut/bolt combinations to mounts 68, 70 using holes in the tabs 72, 74 as well as matching holes in the mounts 68, 70. The mounts 68, 70 themselves may form part of the band 18 and may be statically disposed within the band 18. Furthermore, the screws or other engagement members that attach the tabs 72, 74 to the mounts 68, 70 may originate from the respective side portions 12/segments 16 themselves. The screws may then extend through respective longitudinal tracks, slots, or openings in the side of the outer surface 60 that faces the portion 12/segment 16 and ultimately attach to the tabs 72, 74. This may be done so that the shafts of the screws may slide along their respective tracks as located on the left and right sides of the person's head as the person wears the apparatus 10 and adjusts the band 18 with respect to the portion 12/segment 16 using the compliant mechanism to suit the person's preferences, head contours, and/or head size.

In some examples, the screws or other engagement members may be configured such that they may not be visible to an observer with the apparatus 10 fully assembled (e.g., by hand). The tracks themselves in the outer surface 60 may also not be visible even if other parts of the outer surface 60 may be. In some non-limiting embodiments, the end segments 64, 66 of the band 18 may even extend beyond the respective tracks in the band 18 and toward the cups 20 themselves by a predetermined amount to aid in the screws and tracks not being visible via the fully-assembled apparatus 10.

Still in reference to FIGS. 11 and 12, also note that in some example implementations the compliant mechanism 62, tabs 72, 74, and/or mounts 68, 70 may be encased or disposed within an inner sheet or sleeve 80 made of polypropylene or another suitable material so that the compliant mechanism 62 itself (or spring or other component used in place of the mechanism 62) may not interfere with or get caught on the outer surface 60. The sheet or sleeve 80 may be open at opposing ends near or at the mounts 68, 70, though in other examples it may be closed at its ends and only have openings where, e.g., screws for the mounts 68, 70 would extend therethrough.

Note that while FIGS. 11 and 12 show an example embodiment of the head rest band 18, other embodiments for the head rest band 18 may also be used. For example, in some implementations the body of the head rest band 18 itself may have a fixed and/or non-adjustable length (e.g., no compliant mechanism), but may also have rigid straps or other mechanical features at each end that enable adjustable positions for the head rest band 18 along the inner length of the arcuate headband itself.

It may now be appreciated that the assembly 10 provides a comfortable fit to a person by, among other things, distributing the weight load of the apparatus between the head rest band 18, which lies on the head of the person wearing the apparatus, and the ear cushions 28, which lie against the side of the head and depend down from the apex segment 14. Lateral pressure from the ear cups 20 against the person's ears may also be dispersed to increase comfort.

While the particular Headset Mechanism for Comfort Coupling Ear cup to Head is herein shown and described in detail, it is to be understood that the subject matter which is encompassed by the present invention is limited only by the claims.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

What is claimed is:

1. An apparatus comprising:

an arcuate headband comprising a continuous band having left and right side portions joining at an apex segment, the left and right side portions terminating in respective arcuate end segments;

a head rest band spanning between the side portions and connected thereto below the apex segment and spaced therefrom; and left and right ear cups defining respective centers and respective peripheries and respectively attached to the arcuate end segments of the left and right side portions such that the left and right ear cups are cambered inward from front to back and such that the arcuate end segments of the left and right side portions are juxtaposed with the respective peripheries and distanced from the respective centers of the respective ear cups, wherein the left and right ear cups each comprise a bar within the respective ear cup that couples a respective arcuate end segment to a roll hinge inside the respective ear cup, the bar extending radially inward within the respective ear cup from the respective arcuate end segment and also extending axially inward within the respective ear cup from the respective arcuate end segment.

2. The apparatus of claim 1, wherein the arcuate end segments are elongated and lie flush against the respective ear cups.

3. The apparatus of claim 1, wherein the arcuate end segments are elongated and have curvatures approximating respective curvatures of the peripheries of the respective ear cups.

4. The apparatus of claim 1, wherein each side portion defines a long axis in a plane, and the respective arcuate end segment extends along an arc in the plane.

5. The assembly of claim 1, wherein the head rest band is less arcuate than the apex segment of the headband.

6. The assembly of claim 1, comprising left and right speakers in the respective left and right ear cups.

7. The assembly of claim 1, wherein each ear cup comprises an ear cushion configured to engage the side of a person's head.

8. The assembly of claim 1, wherein each arcuate end segment comprises a width in a dimension extending away from the respective ear cup and a thickness in a dimension extending along the respective ear cup, and the width is greater than the thickness.

9. An apparatus comprising:

an arcuate headband comprising a continuous band having left and right side portions joining at an apex segment, the left and right side portions terminating in respective end segments; and left and right ear cups defining respective centers and respective peripheries and respectively attached to the end segments of the left and right side portions such that the left and right ear cups are cambered inward from front to back and such that the end segments of the left and right side portions are juxtaposed with the respective peripheries and distanced from the respective centers of the respective ear cups, the left and right ear cups each comprising an at least partially circular element within the respective ear cup that couples a respective end segment to a center of the respective ear cup.

10. The apparatus of claim 9, comprising:

a head rest band spanning between the side portions and connected thereto below the apex segment and spaced therefrom, wherein the head rest band comprises a compliant mechanism for the head rest band to move with respect to the arcuate headband.

11. The apparatus of claim 9, wherein the end segments are elongated and lie flush against the respective ear cups.

12. The apparatus of claim 9, wherein the end segments are elongated and have curvatures approximating respective curvatures of the peripheries of the respective ear cups.

13. The apparatus of claim 9, wherein each side portion defines a long axis in a plane, and the respective end segment extends along an arc in the plane.

14. The assembly of claim 9, wherein each end segment comprises a width in a dimension extending away from the respective ear cup and a thickness in a dimension extending along the respective ear cup, and the width is greater than the thickness.

15. The assembly of claim 9, wherein the element extends radially inward within the respective ear cup from the respective end segment and also extending axially inward within the respective ear cup from the respective end segment.

16. An apparatus comprising:

an arcuate headband comprising a band having left and right side portions joining at an apex segment, the left and right side portions terminating in respective end segments; and left and right ear cups defining respective centers and respective peripheries and respectively attached to the end segments of the left and right side portions such that the end segments of the left and right side portions are juxtaposed with the respective peripheries and distanced from the respective centers of the respective ear cups, each end segment being coupled to the center of the respective ear cup by structure inside the respective ear cup.

17. The assembly of claim 16, wherein the left and right ear cups are respectively attached to the arcuate end segments of the left and right side portions such that the left and right ear cups are cambered inward from front to back.

18. The assembly of claim 17, wherein the left and right ear cups each comprise an element within the respective ear cup that couples a respective arcuate end segment to a hinge inside the respective ear cup, the element extending radially inward within the respective ear cup from the respective arcuate end segment.

19. The apparatus of claim 16, wherein the end segments are elongated and lie flush against the respective ear cups.

20. The apparatus of claim 16, wherein the end segments are elongated and arcuate to have curvatures approximating respective curvatures of the peripheries of the respective ear cups.

21. The apparatus of claim 16, wherein the end segments are elongated, curved, and disposed to lie along a curved outer periphery of the respective ear cups along front portions of the respective ear cups such that the end segments apply pressure to a wearer's head where the front portions of the ear cups meet the wearer's head, the end segments being substantially equidistant along their respective lengths from the respective centers of the respective ear cups.

22. The apparatus of claim 16, wherein each end segment is coupled to the center of the respective ear cup on an inside portion of the respective ear cup.

* * * * *